US005525011A

United States Patent [19]

Huang

[11] Patent Number: 5,525,011

[45] Date of Patent: Jun. 11, 1996

[54] SEMI-SUBMERGED MOVABLE MODULAR OFFSHORE PLATFORM

[75] Inventor: Yen T. Huang, Dallas, Tex.

[73] Assignee: San Tai International Corporation, Dallas, Tex.

[21] Appl. No.: 418,545

[22] Filed: Apr. 7, 1995

[51] Int. Cl.[6] ..... B63B 35/44

[52] U.S. Cl. ..... 405/223.1; 405/224; 114/264; 114/266

[58] Field of Search ..... 405/195.1, 203, 405/210, 223.1, 224; 52/80.1, 81.1, 81.2, 81.3, 169.2, DIG. 10; 114/264, 265, 266

[56] References Cited

U.S. PATENT DOCUMENTS

| | | | |
|---|---|---|---|
| 3,111,692 | 11/1963 | Cox | 405/223.1 X |
| 3,154,039 | 10/1964 | Knapp | 405/223.1 X |
| 3,327,780 | 6/1967 | Knapp et al. | 405/223.1 X |
| 3,468,082 | 9/1969 | Hadley | 52/81.2 |
| 3,577,946 | 5/1971 | Horton | 405/223.1 X |
| 3,982,401 | 9/1976 | Loggins | 405/223.1 X |
| 3,983,706 | 10/1976 | Kalinowski | 405/223.1 X |
| 4,113,206 | 9/1978 | Wheeler | 52/81.2 X |
| 4,288,947 | 9/1981 | Huang | 52/2 |
| 4,437,794 | 3/1984 | Grimsley et al. | 405/224 |
| 4,583,330 | 4/1986 | Huang | 52/2 |
| 4,702,648 | 10/1987 | Stageboe et al. | 405/224 |

*Primary Examiner* John A. Ricci
*Attorney, Agent, or Firm* Charles Cotropia

[57] ABSTRACT

A modular offshore movable drilling platform support includes a double-layer dodecahedrous float having an outer dodecahedrous structure and an inner dodecahedrous structure defining a sealed volume therebetween. The outer dodecahedrous structure is anchored to the ocean floor by tout mooring polyester fiber ropes or aramid guide ropes, and the inner dodecahedrous structure is tied to the ocean floor directly through the use of a riser system. The sealed volume between the inner and outer dodecahedrous structures provides a buoyancy force upon installation of the dodecahedrous float in its position offshore. Both the outer and the inner dodecahedrous structures have 12 pentagonal surfaces formed by the use of rigid Y substructural space components, which contribute to simplified erection process with substantial saving in erection time. The need for expensive underwater welding is minimized in this construction. This system can be easily salvaged or moved to other locations for reuse with a minimum environmental impact when it is found that no productive well can be made at the exploratory site. Once a production well is located, the platform can be converted to a permanent production platform with very little effort.

29 Claims, 9 Drawing Sheets

FIG. 9a
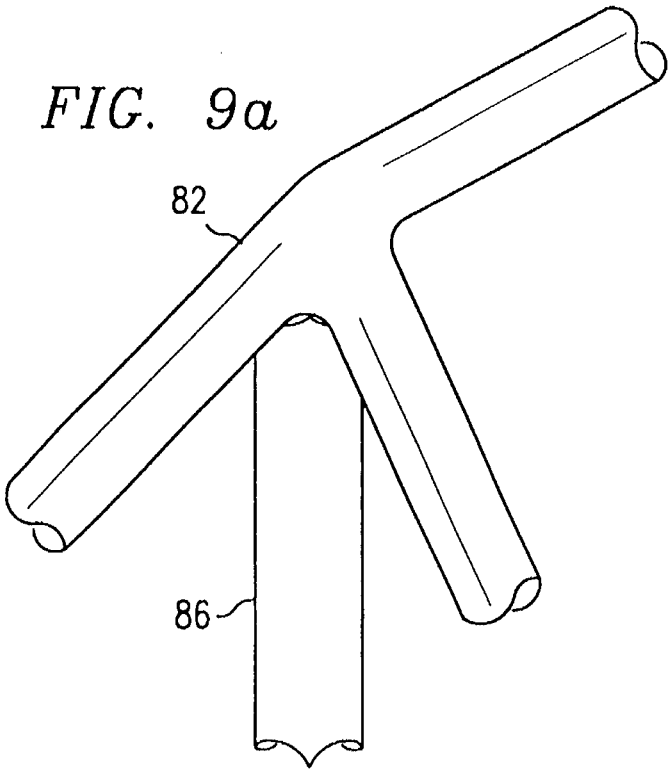
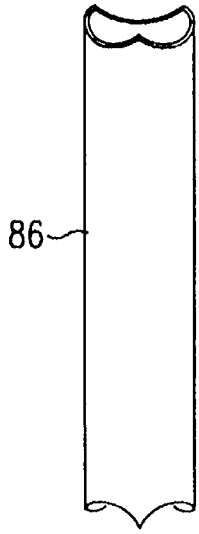
FIG. 9b
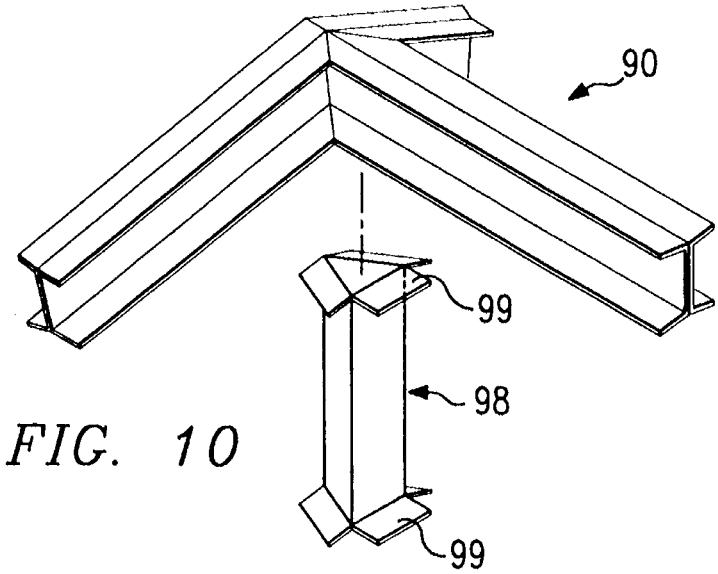
FIG. 10

SEMI-SUBMERGED MOVABLE MODULAR OFFSHORE PLATFORM

TECHNICAL FIELD OF THE INVENTION

This invention relates to offshore platforms and more specifically to semi-submerged movable modular offshore platforms used for deep sea oil exploration.

BACKGROUND OF THE INVENTION

In the exploration of oil in offshore, deep sea locations, it is necessary that the oil drilling equipment be supported on a platform at some distance above the ocean floor. For water depths greater than about 1000 ft. the weight and foundation requirements of traditional offshore structures make them less attractive than other design forms. Two such traditional forms are the guyed tower and tension-leg platform.

The guyed-tower concept is illustrated in FIG. 2. It consists of a uniform cross-sectional support structure held upright by several guy lines that run to clump weights on the ocean floor. From the clump weights, the lines then run to conventional anchors to form a dual stiffness mooring system. Under normal operating loads, the clump weights remain on the sea floor and lateral motion of the structure is restrained. However, during a severe storm, the clump weights are lifted off the sea floor by loads transferred from the structure to the clump weights through the guy lines. This action permits the tower to absorb the environmental loadings on it by swaying back and forth without overloading the guy lines. The guyed-tower concept is presently considered to be applicable to water depths of about 2000 ft.

FIG. 3 illustrates the tension-leg concept. In this design, vertical members are used to anchor the platform to the sea floor. This upper part of the structure is designed with a large amount of excessive buoyancy so as to keep the vertical members in tension. Because of this tension, the platform remains virtually horizontal under wave action. Lateral excursions are also limited by the vertical members, since such movements necessarily cause them to develop a restoring force. A major advantage of the tension-leg concept is its relative cost insensitivity to increased water depths. At the present time, it appears that the main limitation on the tension-leg platform arises from dynamic inertia forces associated with the lateral oscillations of the platform in waves. These become significant at water depths of about 3000 ft.

In the use of either of these prior art designs, substantial underwater welding in physically restrictive environments is required. Such costs are significantly increased with the increase in depths in which the structures are used. Also, the depths at which these platforms may be used are limited because of costs and stability problems.

Because of the substantial costs of using either guyed tower platforms or tension leg platforms in substantial depths, drill ships have been used. However, availability of such ships as well as maintaining such ships in position over the well site require expensive precision navigational equipment. Such equipment adds significantly to the costs involved and often renders this option unacceptable.

The inventor intends to rectify the above shortcomings by usage of manufacturing and prefabricating facilities where computer controlled precision equipments are available. With good quality control on both materials and equipments, high quality modular space components can be casted, blow-molded, compressed and prefabricated. Such modular components shall contribute to substantial reduction in the need for the expensive underwater welding work, which is plagued with crack and fatigue failure problems.

The dodecahedrous float platform (DFP) introduced here is a hybrid of the guyed tower and the tension leg platform systems, using equi-angular rigid Y modular space components. The shortened erection time, reduction in the need for underwater welding replaced by field bolts simple fabrication and erection procedures should contribute to a substantial cost reduction on offshore platform construction, which currently run at $1.2 billion dollars on the 3000 ft. deep Mars project (p. 8, Oct. 18, 1993—Engineering News-Record, McGraw Hill).

SUMMARY OF THE INVENTION

The present DFP system overcomes above mentioned limitations and problems found in the prior art by providing a modular offshore drilling platform support for use in deep sea oil exploration which incorporates a dodecahedrous float which is stabilized by a series of guided cables and clump weights that are anchored to the ocean floor. The drilling platform is constructed on such dodecahedrous float which can be fabricated on shore and transported to the job site by direct towing. In one preferred embodiment, the dodecahedrous float is comprised of a double hull construction having an outer dodecahedrous structure anchored from its outer surface to the ocean floor by the aramid guy ropes. An inner dodecahedrous structure is supported within the outer dodecahedrous structure to define a sealed volume therebetween. The turret structure is tied to the ocean floor directly through the use of a riser system.

The sealed volume within the outer dodecahedrous structure, or in the double hull construction, the volume between the inner and outer dodecahedrous structures provide a buoyancy force upon installation of the dodecahedrous float in its position offshore. Such buoyancy will support, in part, the substantial weight exerted on the platform by the drilling equipment and associated structure. Guy cables and clump weights anchored to the ocean floor support the dodecahedrous float, and the entire assembly is stabilized to a designated location through a riser system to prepare it for drilling.

The use of the double hull construction avoids the necessity of using excessive plate thickness panels under high loading conditions, and also provides for added flexibility for metacentre control. The use of the double hull construction permits placement of the metacentre above the center of gravity to produce a stable floating body.

In a preferred embodiment, the outer dodecahedrous structure has twelve pentagonal surfaces. This structure is formed by the use of twenty rigid Y substructural components which are either connected directly, one to the other, or through extensions depending upon the radius of the dodecahedrous surface desired. The rigid Y substructural components are comprised of first, second and third members which are interconnected to define a rigid Y-shaped joint with respective space angles between each pair of members. In the preferred embodiment, the rigid Y component is formed such that the angle between any two branches of the Y substructural component is 108°.

Similarly, the inner dodecahedrous structure has twelve pentagonal surfaces. Such structure is generated by using twenty rigid Y substructural components connected by thirty connectors to form the supporting structure for the dodecahedron. The angle between any two branches of the rigid Y substructural component is 108°.

The double layered dodecahedrous float is designed to support the heavy downward loads from the platform operations as well as the environmental forces, such as winds, rain, snow, ice, earthquakes, as well as the action and turbulence exerted by the waves and currents in which the assembly operates. The excess buoyancy created by the float applies tensions to the aramid guy lines to stabilize the float at the designated location over the well production trees.

The riser is connected to the drilling system passing through the inner dodecahedron. The turret mooring system developed by NKK, Japan, may be adapted for the inner dodecahedron.

By use of the turret mooring system, the platform remains virtually horizontal. Further, in view of the shape of the exterior shell defined by the outer dodecahedron, the platform will exhibit little lateral excursions under wave action on the water surface. The guy system attachments on the outer dodecahedron will further contribute to the stability of the offshore platform.

Since dodecahedron is not a symmetric crystal body, when symmetric constrictions are desired, semi-dodecahedrous structures (as shown in FIG. 15) or elongated dodecahedrous structures may be used.

Although this invention is intended for deep sea offshore structures, those who are skilled in the art will find that this invention can be applied to the shallow offshore structure as well as on-shore structures.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIG. 9*a* is a detailed view showing the structure for interconnecting the inner and outer dodecahedrous structure;

FIG. 9*b* is an enlarged perspective view of the connecting structure between the inner and outer dodecahedrous structures where a tubular skeletal structure is employed;

FIG. 10 shows an alternative connecting structure used between the inner and outer dodecahedrous structures where a channel-shaped skeletal structure is used as shown in FIGS. 6*a*, 6*b* and 6*c;*

DETAILED DESCRIPTION

A preferred embodiment of the present invention is herein described wherein like or identical parts are identified throughout the specification and drawings using the same numerical designation. Given the environment in which the present invention is used, namely in deep sea oil exploration, the drawings are not necessarily to scale and in some instances, components have been enlarged to more clearly illustrate features of the present invention.

Figure 1:
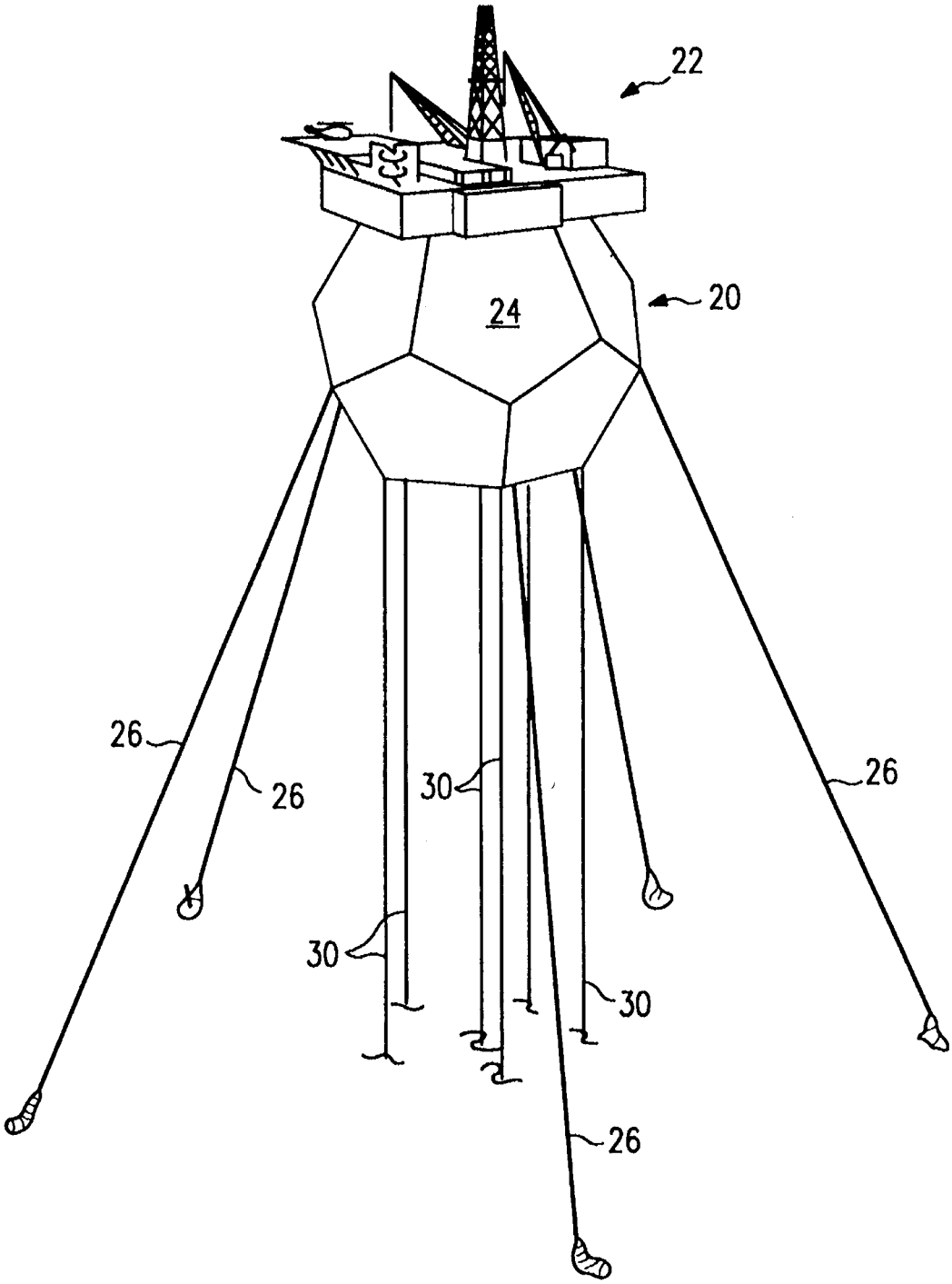
FIG. 1 is perspective view of the semi-submerged modular offshore platform according to the present invention.

Referring to FIG. 1, the proposed semi-submerged dodecahedrous float 20 is shown supporting an operational platform 22 connected to the outer dodecahedrous structure 24. This outer dodecahedrous structure 24 is anchored to the ocean floor by aramid guy ropes 26. The dodecahedrous float is also supported from the ocean floor by a riser system 30.

Figure 2:
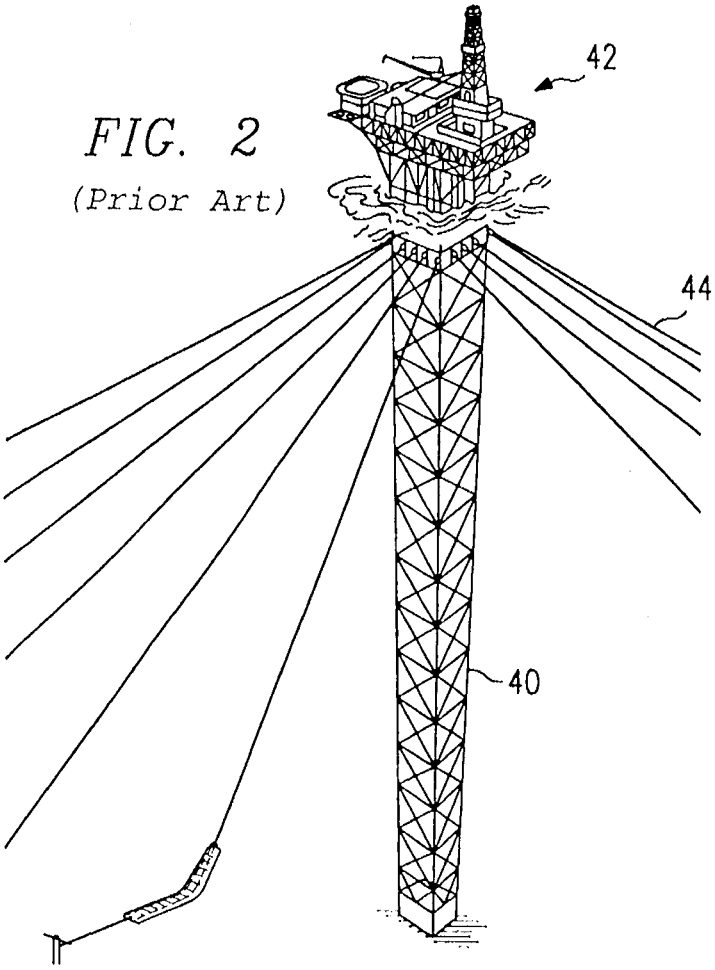
FIG. 2 (Prior Art)
FIG. 2 is a perspective view of the prior art guyed tower platform which has been used previously hereto.
Figure 3:
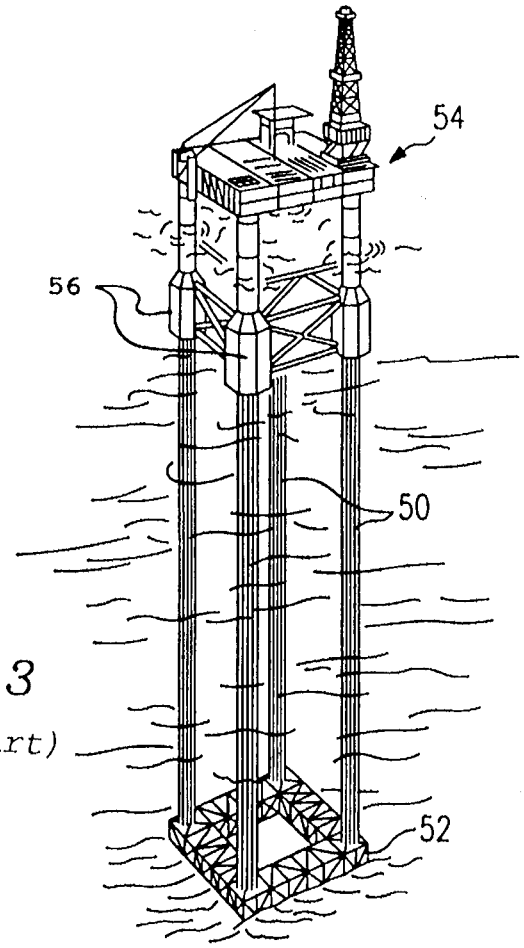
FIG. 3 (Prior Art)
FIG. 3 is a perspective view of the prior art tension leg platform which has been used previously hereto.

The dodecahedrous structure of FIG. 1 is a hybrid of the currently known guyed tower platform structure shown in FIG. 2 and the tension leg platform structure shown in FIG. 3. The guided tower platform structure of FIG. 2 consists of a segmented tower 40 which supports the drilling platform 42 from the ocean floor and uses guy cables 44 to provide stability to the tower. The tension leg platform shown in FIG. 3 includes a plurality of tension leg supports 50 connected to a footing 52 at the ocean floor and concrete buoys 56 at the top. The production platform 54 is supported by the buoys 56 and tension legs 50 as shown in FIG. 3.

Where wells are drilled in offshore locations at substantial depths, the cost of using either the guyed tower platform or tension leg platform is substantial and in many cases is economically prohibitive. The present invention is a hybrid design which provides economy with regard to materials, labor, assembly and prefabrication production.

Figure 4:
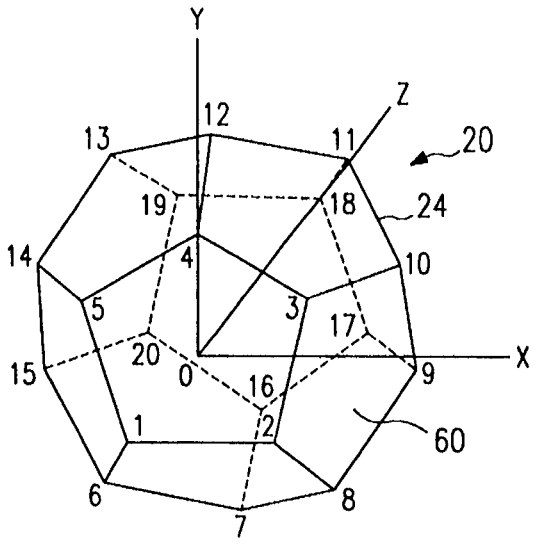
FIG. 4 is a schematic perspective view of the dodecahedrous structure used in supporting the drilling platform of the present invention.
Figure 5A:
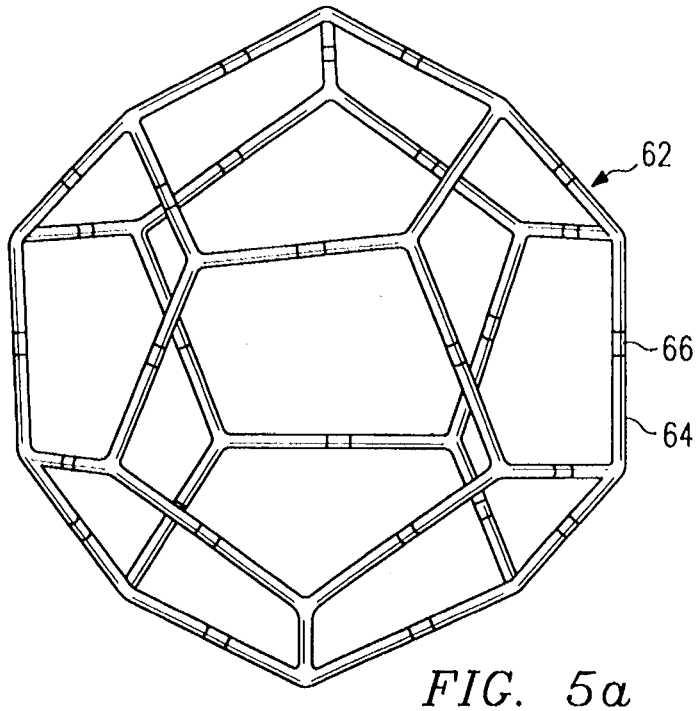
FIG. 5*a* is a perspective of the outer dodecahedrous structure with the outer skin removed showing the skeletal structure of the outer dodecahedrous structure.
Figure 5B:
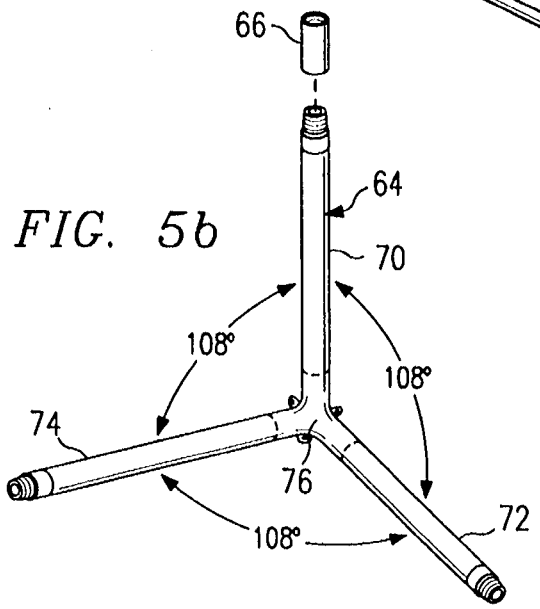
FIG. 5*b* is a perspective view showing the rigid Y-shaped structural component used in construction of the dodecahedrous structure.

Referring to FIG. 4, a double-layer dodecahedrous float 20 used as the heart of the semi-submergible modular offshore platform of the present invention is shown. The double-layer dodecahedrous float 20 is composed of two similar dodecahedrous structures with outer and inner radii. The outer dodecahedrous structure 24 is specifically shown in FIG. 4 with the outer skin 60 attached thereto to form a fluid tight outer shell. In a preferred embodiment, the dodecahedrous structures and outer skins are made from steel alloys, concrete, or reinforced plastic materials. FIG. 5*a* shows the skeletal structure of the outer dodecahedrous structure 62. FIG. 5*b* illustrates the rigid Y substructural component 64 and couplers 66 which are used to make up skeletal structure 62. Specifically, Y substructural component 64 consists of first, second and third tubular branches 70, 72 and 74 of equal length, which are interconnected at a node 76 to define a rigid Y-shape having obtuse spaced angles between each pair of tubular branches. In the embodiment illustrated in FIG. 5*b*, the three spaced angles are each 108°, as shown. In one embodiment, the Y-shaped substructural components are fabricated as a single, jointless member, without any joints along the lengthwise span of any part thereof.

Referring to FIG. 5*a*, by interconnecting twenty (20) Y-shaped structural components using thirty (30) connectors 66, at the midpoint between adjacent nodes 76 of the Y substructural components, the basic dodecahedrous structure shown in FIG. 5*a* is created. Often times, two connectors 66 may be used at points of contraflexure when distances between two adjacent nodes 76 are exceedingly large. A straight member with properly prepared ends to provide for interconnection thereof may be added between the points of contraflexure. Because all angles between any two branches of the rigid Y substructural components measure 108°, the assembly may be accomplished readily without skilled labor.

Figure 6A:
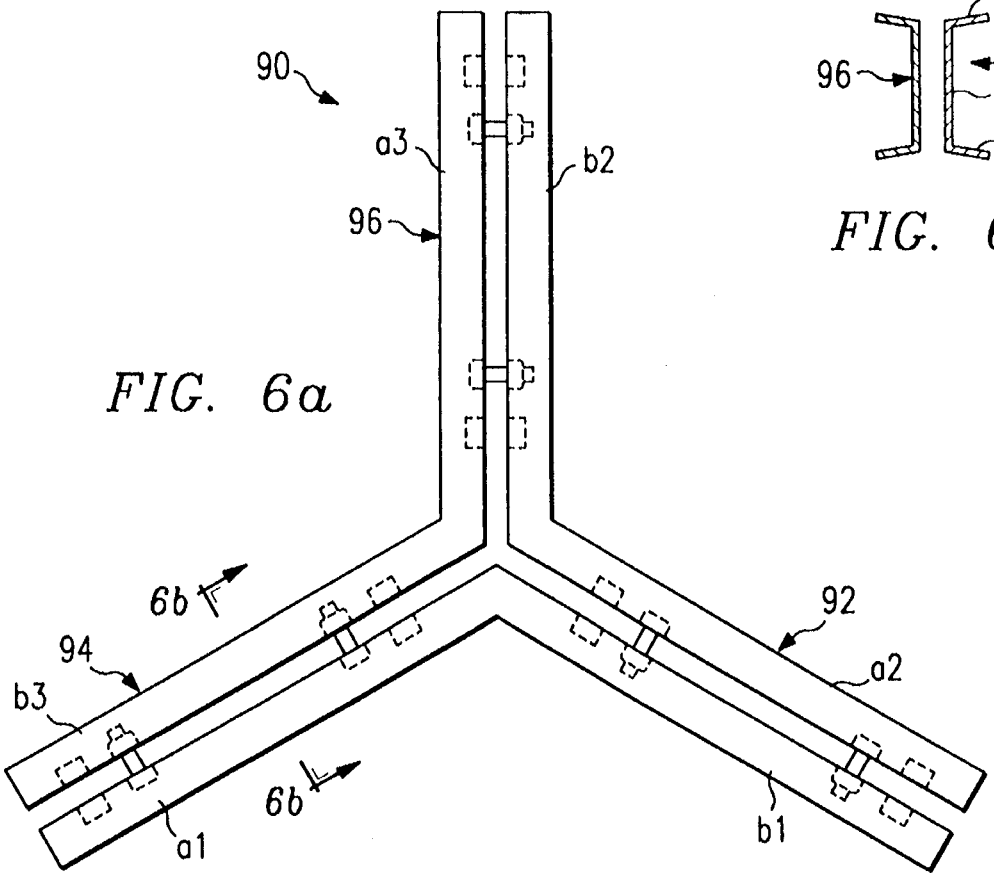
FIGS. 6*a*, 6*b* and 6*c* show alternative designs of the rigid Y-shaped structural component used in construction of the dodecahedrous structure, FIG. 6*a* being a plan view, FIG. 6*b* being a section view taken along line 6*b*—6*b* of FIG. 6*a*, and FIG. 6*c* being a perspective view thereof.
Figure 6B:
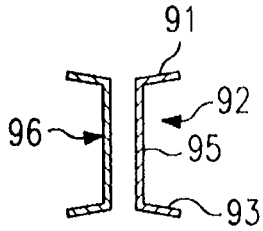
Figure 6C:
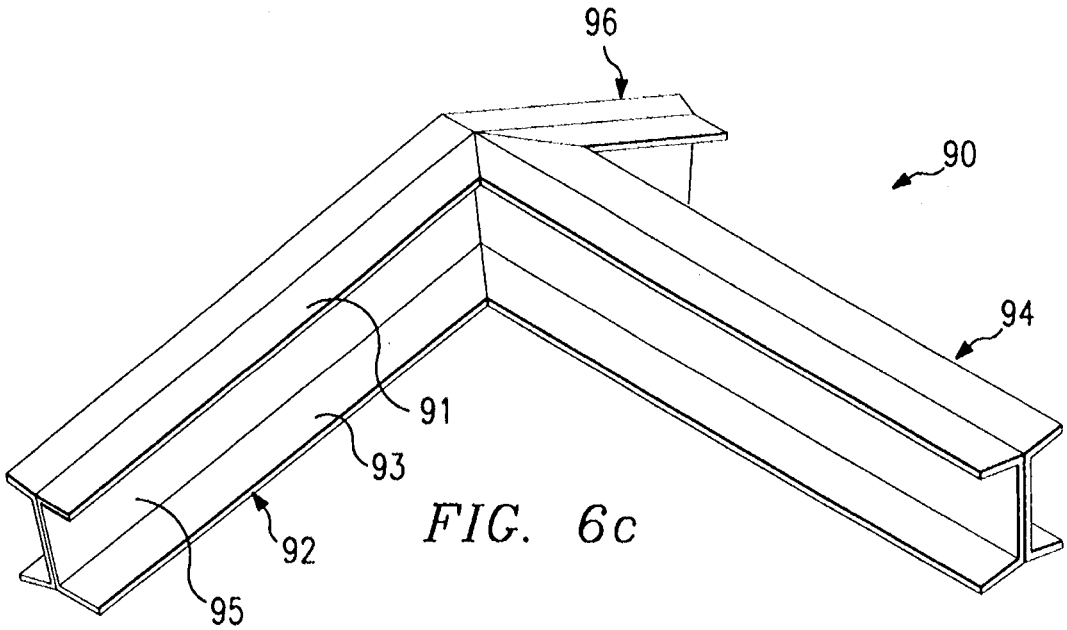

The particular design and construction of the Y substructural components 64 and connectors 66 may be made in accordance with the design shown in the inventor's prior U.S. Pat. No. 4,288,947, issued Sep. 15, 1981, entitled "Modular Inflatable Dome Structure," and U.S. Pat. No. 4,583,330, issued Apr. 22, 1986, entitled "Modular Inflatable Dome Structure," such disclosures being incorporated herein by reference. Those skilled in the art will appreciate that the modular construction taught herein could be accomplished by using Y-shaped substructural components that are built up from subcomponents as is shown in FIGS. 6*a*, 6*b* and 6*c*, described hereinafter in greater detail.

Because the dodecahedrous structure of the present invention is composed of two similar dodecahedrons with outer and inner radii, the description of the dodecahedrous float is referred to herein in terms of a generic member length, L, which represents the dimension between two adjacent nodes 76 of the same dodecahedron. Referring now to FIG. 4, if rectangular coordinates are drawn at the center of the bottom pentagon as shown, the following coordinates can be established at each designated nodal point. By assuming that each branch of the rigid Y substructural components has a L/2 length, the position of the nodal points can established as follows:

| | | | | |
|---|---|---|---|---|
| 1: | (−0.5L | , −0.6882L, | 0 ) | (1) |
| 2: | ( 0.5L | , −0.6882L, | 0 ) | (2) |
| 3: | ( 0.8090L | , 0.2629L, | 0 ) | (3) |
| 4: | ( 0 | , 0.8507L, | 0 ) | (4) |
| 5: | (−0.8090L | , 0.2629L, | 0 ) | (5) |
| 6: | (−0.8090L | , −1.1135L, | 0.8506L) | (6) |
| 7: | ( 0 | , −1.3764L, | 1.3763L) | (7) |
| 8: | ( 0.8090L | , −1.1135L, | 0.8506L) | (8) |
| 9: | ( 1.3090L | , −0.4254L, | 1.3763L) | (9) |
| 10: | ( 1.3090L | , 0.4254L, | 0.8506L) | (10) |
| 11: | ( 0.8090L | , 1.1135L, | 1.3763L) | (11) |
| 12: | ( 0 | , 1.3764L, | 0.8506L) | (12) |
| 13: | (−0.8090L | , 1.1135L, | 1.3763L) | (13) |

-continued

| | | | | |
|---|---|---|---|---|
| 14: | (−1.3090L | , 0.4254L, | 0.8506L) | (14) |
| 15: | (−1.3090L | , −0.4254L, | 1.3763L) | (15) |
| 16: | ( 0 | , −0.8507L, | 2.2270L) | (16) |
| 17: | ( 0.8090L | , −0.2629L, | 2.2270L) | (17) |
| 18: | ( 0.5L | , 0.6882L, | 2.2270L) | (18) |
| 19: | (−0.5L | , 0.6882L, | 2.2270L) | (19) |
| 20: | (−0.8090L | , −0.2629L, | 2.2270L) | (20) |

Figure 7:
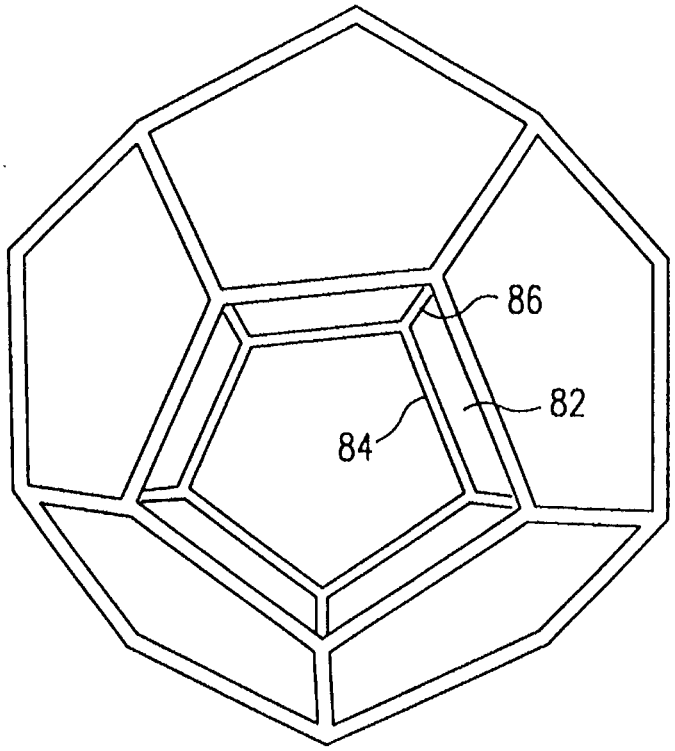
FIG. 7 is a perspective view showing the relationship of the inner and outer dodecahedrous structures and their interconnection.
Figure 8:
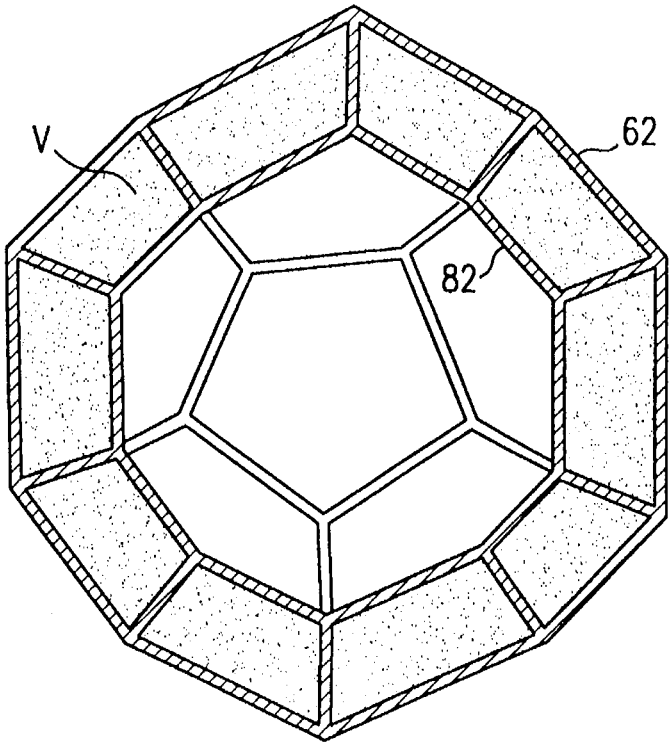
FIG. 8 is a horizontal section view of FIG. 7.

Referring to FIGS. 7 and 8, the inter-relationship of the inner and outer dodecahedrous structures is shown. Specifically, an inner dodecahedrous structure 82 is formed in substantially the same way as the outer dodecahedrous structure 62 using a plurality of rigid Y substructural components 84 interconnected by couplings 86 (not shown).

FIG. 8 shows a horizonal section view of the dodecahedrous structure showing the inner dodecahedrous structure 82 and the outer dodecahedrous structure 62 with the sealed volume V therebetween. As can be seen in FIGS. 7 and 8, connecting struts 86 support inner dodecahedrous structure 82 within outer dodecahedrous structure 62.

As has been described, the inner dodecahedrous structure 82 is supported within and spaced from the outer dodecahedrous structure 62, each having an air and water impermeable skin applied thereon. The volumes of the outer and the inner dodecahedrons can be expressed by the following relationship:

$$V_o = 7.6631 l_0^3 \tag{21}$$

$$V_i = 7.6631 l_i^3 \tag{22}$$

where $l_0$ and $l_i$ represent lengths of each pentagonal side of the outer and inner dodecahedrons, respectively.

Assuming that the entire dodecahedrous float 20 is submerged in the water, the displaced water volume can be given by the difference in volumes represented by equations (21) and (22). Archimedes' principle gives the buoyant force of the float as follows:

$$B = \gamma(V_o - V_i) \tag{23}$$

where γ denotes the specific weight of the water. B is the buoyant force which is proportional to the volume of water displaced. The resulting buoyant force provided by the design will be increased by the contribution which is provided from the displacement resulting from the connecting members between the production platform and the dodecahedrous float.

FIGS. 9*a* and 9*b* show further details of the interconnection between the inner and outer dodecahedrous structures. Inner dodecahedrous structure 82 is joined by a strut 86 to outer dodecahedrous structure 62. FIG. 9*b* shows the contour of the ends of struts 86 which facilitate the attachment of the inner and outer dodecahedrous structure. Struts 86 are field welded between the dodecahedrous structures to make the desired connection. As can be appreciated, the struts 86 shown in FIG. 9*b* are used in making connections where the skeletal structures of the dodecahedrous structures are tubular.

The skeletal structure of the dodecahedrous structures may be of the form shown in FIGS. 6*a*, 6*b*, 6*c* and 10 which is specifically composed of channel sections as illustrated. In this alternative embodiment, the rigid Y-shaped modular construction member 90 is assembled from three prefabricated, channels or U-shaped space components 92, 94 and 96. The two arms of each U-shaped space component define one of the space angles of the rigid Y-shaped modular construction member. Arms a1 and b1 of the prefabricated U-shaped space component 92 define the space angle between the first and second branches. Arms a2 and b2 of the second prefabricated space component 94 define the space angle between the second and third branches of the rigid Y-shaped modular construction member. Arms a3 and b3 of the third prefabricated U-shaped space component 96 define the space angle between the first and third branches of the rigid Y-shaped modular construction member.

The rigid Y-shaped modular construction member 90 can be assembled in the field by rigid attachment of the U-shaped components to one another using any conventional, permanent means such as welding, bolting or metal screws. The first branch of the Y-shaped modular construction member is formed by rigidly attaching arm a1 of the first U-shaped component to arm b3 of the third U-shaped component. The second branch of the Y-shaped modular construction member is formed by rigidly attaching arm b1 of the first U-shaped component to arm a2 of the second U-shaped component. The third branch of the Y-shaped modular construction member is formed by rigidly attaching arm b2 of the second U-shaped component to arm a3 of the third U-shaped component.

FIG. 6*b* shows the cross-section of a typical branch formed from the U-shaped components, the components being shown separated slightly for clarity. The U-shaped channels are formed by a web 95 and flanges 91 and 93 extending longitudinally along the branches of the modular construction members. The U-shaped components can be manufactured from suitable material, including sheet metal and premolded reinforced plastic, which can withstand the forces to which the structure will be subjected.

Referring now to FIG. 10, in this configuration, the inner and outer dodecahedrous structures are connected by using a triangular box-type spacer 98 having flanges 99 for either welding or attachment by bolts between the inner and outer dodecahedrous structure.

Figure 11:
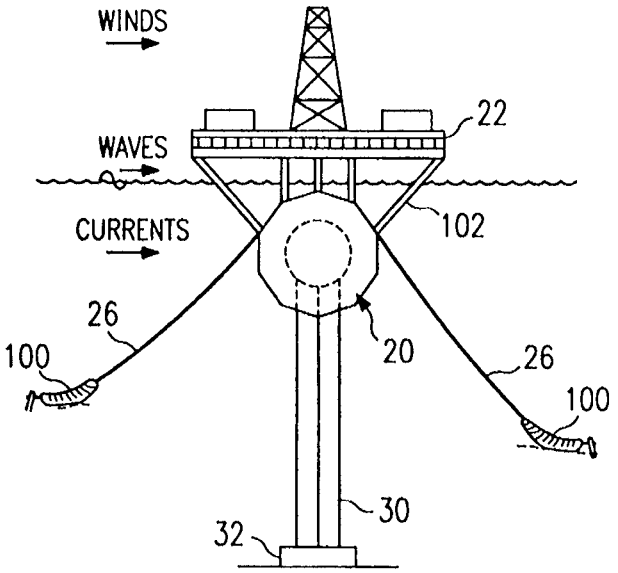
FIG. 11 is an elevational view showing the dodecahedrous structure supporting an offshore platform.

FIG. 11 is an elevational view of the present invention in assembly. As can be seen in FIG. 11, dodecahedrous float 20 is supported from the ocean floor by a plurality of risers 30 supported from a footing 32. Specifically, as is shown in FIG. 11, risers 30 are attached to the inner dodecahedrous structure 82. Aramid guy ropes 26 anchor the dodecahedrous float 20 to the ocean bottom using clump weights 100 in the normal fashion. As can be seen in FIG. 11, dodecahedrous float 20 is submerged below the water line and supports a offshore drilling platform 22 by way of appropriate connecting supports 102. For use in offshore locations, structures must be designed to resist forces normally encountered in this environment. In addition, such structures must be designed for surface waves and currents which will be confronted in the ocean environment. Treatments of the environmental forces can be found in standard text books on ocean engineering (such as the work by T. H. Dawson (1983), "Offshore Structural Engineering", Prentice-Hall, Inc., Engelwood Cliffs, N.J., 07632). Due to the buoyant force created by the double layer dodecahedrous float, guy ropes are normally subject to tensile forces, thereby adding additional stability.

Figure 12A:
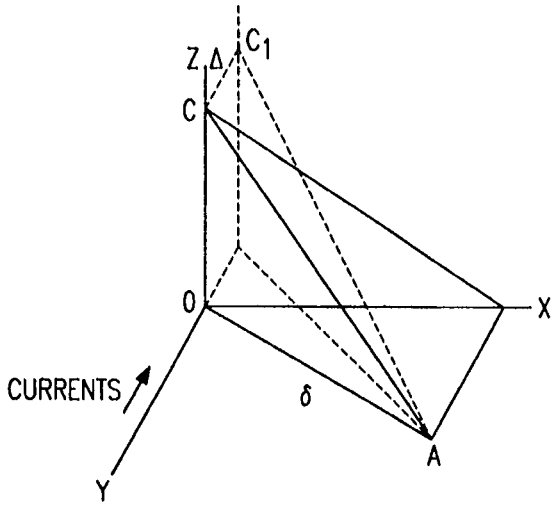
FIG. 12*a* is a diagram showing the resultant lateral movement, Δ, which the submerged dodecahedrous structure will move as a result of the resultant force $W_r$.
Figure 12B:
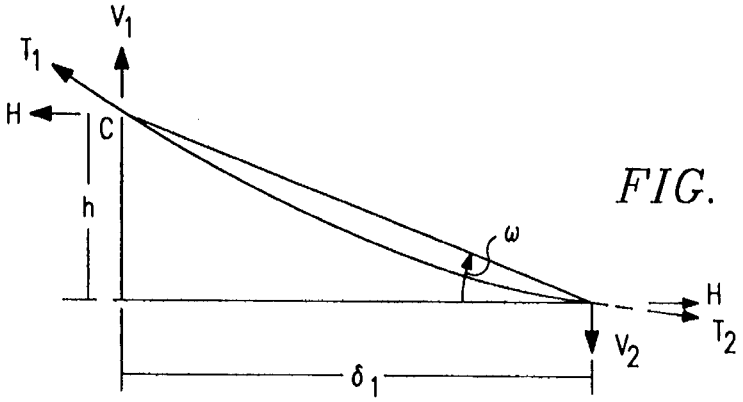
FIG. 12*b* shows the chord angle ω of the guy rope in the plane of the resultant force $W_r$, such angle being a variable in the calculation of the lateral movement of the dodecahedrous structure as a result of wave and current forces.

Under wave and current forces, the submerged dodecahedrous float will move laterally in the direction of the resultant force by the amount A as shown in FIG. 12*a*. By designating the resultant force on a guy rope as $W_r$, the stretch of the guy rope, $\Delta_g$, can be expressed as follows (Steinman, D. B., (1929), "A Practical Treatise on Suspension Bridges," John Wiley & Sons, Inc., New York):

$$\Delta_g = \frac{H\delta}{A_g E_g} \times \left( \sec^2\omega + \frac{W_r^2}{12H^2} \right) \tag{24}$$

where H is the horizontal component of the tension in the guy rope in kips, $A_g$ is the cross sectional area of the guy rope in $in^2$, $E_g$ is the modulus of elasticity of the guy rope in kips per $in^2$, $\delta$ is the horizontal distance of the guy in feet in the plane of the resultant force $W_r$, and $\omega$ is the chord angle of the guy rope in the plane of the resultant force $W_r$ as shown in FIG. 12*b*.

The appropriate length of the guy, L, in feet can be given by $$L = \delta \times \left( \sec\omega + \frac{W_r^2}{24H^2 \times \sec^3\omega} \right) \tag{25}$$

In the actual designs, effect of temperature must be taken into consideration. The guy length at temperature t°F., $L_t$, can be given by $$L_t = L_o[1 + 0.0000065(t - t_o)] \tag{26}$$

where $$L_o = L - \Delta_g \tag{27}$$

$L_o$ is the unstressed length of the guy rope at $t_o$F. degree temperature.

Methods of multi-level guyed tower analysis and design have been provided in the writings of Cohen, E., and Perrin, H., (1957), "Design of Multi-Level Guyed Towers", Journal of the Structural Division, Proceedings of the ASCE, September, 1957, pp 1355 & 1356, 1–29; Odley, E. G., (1966), "Analysis of High Guyed Towers", Journal of the Structural Division, Proceedings of the American Society of Civil Engineers, February, 1966, pp. 169–198; and Huang, Y. T., (1968), "User's Guide for Guyed Microwave Tower Program, TOWRCZ—Version 4", WP-6779, Collins Radio Company, 1225 N., Alma Rd., Richardson, Tex. 75081. Therefore, the disclosures therein will not be repeated herein but are incorporated herein by reference. The forces provided by currents and waves must be considered, however, along with the wind and other forces, in final design and construction.

Figure 13:
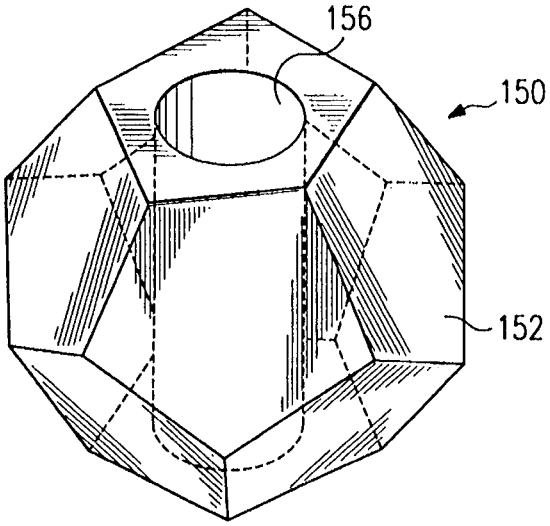
FIG. 13 is a perspective view of an alternative embodiment of the dodecahedrous structure of the present invention.
Figure 14:
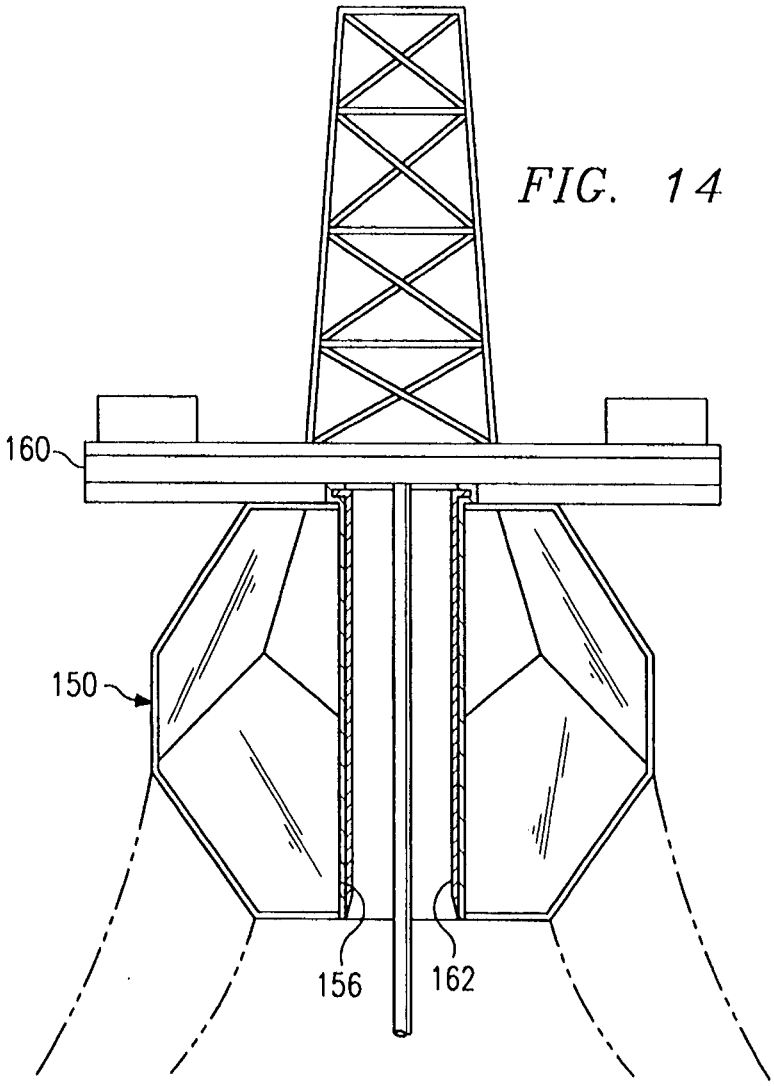
FIG. 14 is a vertical section view showing the alternative embodiment of FIG. 13 in application supporting an offshore platform.

FIGS. 13 and 14 show a modified structure incorporating the present invention to support an offshore platform. Specifically, referring to FIGS. 13 and 14, a dodecahedrous float 150 has an outer dodecahedrous structure 152 and an inner dodecahedrous structure 154 defining a sealed volume therebetween. A cylindrical opening 156 is formed in dodecahedrous float 150. A drilling platform 160 (FIG. 14) is supported over dodecahedrous float 150 and has a sleeve 162 received within opening 156 of float 150. Sleeve 162, in association with platform 160 securely affixes the platform to dodecahedrous float 150 and also permits rotation of the platform and thus the rotation of any component thereon.

Figure 15:
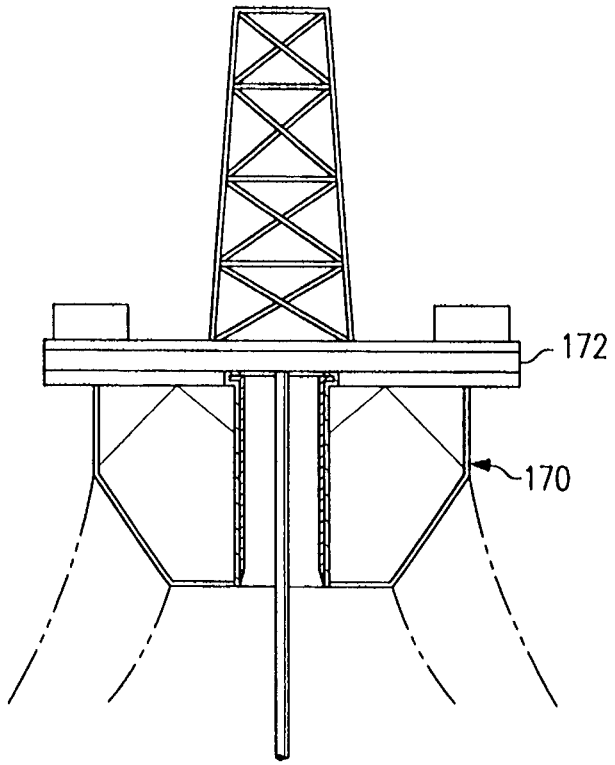
FIG. 15 is a further alternative to the embodiment shown in FIGS. 13 and 14.
Figure 16:
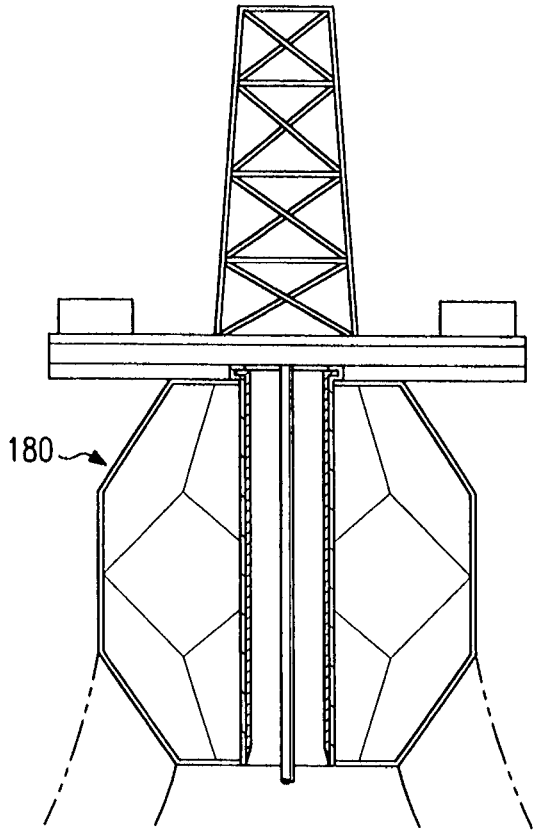
FIG. 16 is a further alternative to the embodiment shown in FIGS. 13 and 14.

FIG. 15 shows an alternative to the embodiment shown in FIGS. 13 and 14 wherein the dodecahedrous float 170 is truncated so that platform 172 is supported at a lower elevation. Alternatively, an elongated dodecahedrous structure, shown in FIG. 16 as 180, may also be used.

It will be understood by those skilled in the art that the embodiments shown herein are subject to change and modification to correspond to the environmental and loading conditions specific to the particular offshore sites on which these units are used. Under excessive loading conditions, more than one dodecahedrous structure may be employed to withstand the tremendous force exerted on the shell structure of the floating body by such loading.

It will also be understood that modular structure provided in this invention is readily movable from one location to another, when exploratory drilling is either completed at one site or when production at that site is either terminated, or where no production is achieved. As is well known in the art, it is necessary to explore numerous potential locations, some of which may not be successful in the production of oil. Thus, the present invention provides a movable floating platform which may be repeatedly used, resulting in the saving of a substantial investment which would otherwise be lost. Once the oil production has been brought on line, the use of this support for the drilling platform may easily be converted to a permanent production facility.

Further, the present dodecahedrous structure can be placed directly on the ocean floor in shallow locations, after the ocean floor is properly cleared and grated for such purpose. The benefits enumerated above will apply with regard to these installations. Particularly, the buoyancy force provided by the present invention will provide support to the structure supported thereby.

Thus, it will be appreciated that the present invention provides a modular offshore drilling platform support for use in deep sea oil exploration which incorporates a double-layer dodecahedrous float. The drilling platform is constructed on such dodecahedrous float which can be fabricated on shore and transported to the job site by direct towing. The dodecahedrous float is comprised of an outer dodecahedrous structure and an inner dodecahedrous structure supported within the outer dodecahedrous structure to define a sealed volume therebetween.

By the use of an inner and outer dodecahedrous structure with a sealed volume therebetween, a buoyancy force is achieved upon installation of the assembly in an offshore position. Such buoyancy will support, in part, the substantial weight exerted on the platform by drilling equipment and associated structure.

Through the use of an outer shape in the form of a dodecahedron, the resultant exterior shape provides a rigid and sturdy construction capable of withstanding the environmental forces and turbulence which is experienced in offshore drilling locations. Further, because the dodecahedron is one of natural crystalline forms, in the present design, it lends itself to being constructed using modular, space components making it easy to assemble in hostile, physically restrictive environments such as those encountered in offshore locations. Further, in view of the shape of the exterior shell defined by the outer dodecahedron, the platform exhibits little external excursions under wave action on the water surface.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without the departing from the spirit and scope of the invention. The present invention is therefore intended to encompass such rearrangements, modifications and substitutions of parts and elements as fall within the spirit and scope of the invention.

I claim:

1. A modular offshore platform support comprising:

an outer dodecahedrous structure having a modular frame construction defining an outer shell with a first radii, an inner dodecahedrous structure having a modular frame construction defining an inner shell having a second radii smaller than the first radii of the outer dodecahedrous structure, and structure supporting said inner dodecahedrous structure within the outer dodecahedrous structure to define a volume therebetween, said volume being fluid tight to provide a buoyant support structure when positioned in an offshore location.

2. The modular offshore platform of claim 1 wherein said modular offshore platform support positions drilling equipment above the ocean floor and further comprising risers for supporting said inner and outer dodecahedrous structures above the ocean floor.

3. The modular offshore platform of claim 2 wherein said outer dodecahedrous structure is positioned by use of guy ropes attached thereto.

4. The modular offshore platform of claim 2 wherein said inner dodecahedrous structure is positioned by support from a riser from the ocean floor to said inner dodecahedrous structure.

5. The modular offshore platform of claim 1 wherein the outer dodecahedrous structure comprises:

a plurality of Y-shaped substructural components, each component comprised of a first, second and third member interconnected to define the Y-shape with respective obtuse space angles between each pair of members, and a plurality of connectors for connecting said Y-shaped substructural components to thereby form the modular dodecahedrous structure.

6. The modular offshore platform of claim 5 wherein the obtuse angle between each pair of members is 108°.

7. The modular offshore platform of claim 5 wherein said members of said Y-shaped substructural components are tubular.

8. The modular offshore platform of claim 5 wherein the inner dodecahedrous structure comprises:

a plurality of rigid Y-shaped substructural components, each component comprised of a first, second and third member interconnected to define the rigid Y-shaped with respective obtuse space angles between each pair of members, and a plurality of connectors for connecting said Y-shaped substructural components to thereby form the modular dodecahedrous structure.

9. The modular offshore platform of claim 8 wherein said members of said Y-shaped substructural components are tubular.

10. The modular offshore platform of claim 8 wherein each said Y-shaped substructural component is constructed using three U-shaped space components.

11. A modular offshore platform support for conducting operations over the ocean floor comprising:

an outer dodecahedrous structure having a modular frame construction with an outer shell with first radii, said dodecahedrous structure being fluid tight to provide a bouyant support structure when positioned in an offshore location, and structure to position said outer dodecahedrous structure above the ocean floor.

12. The modular offshore platform of claim 11 wherein the outer dodecahedrous structure comprises:

a plurality of Y-shaped substructural components, each component comprised of a first, second and third member interconnected to define the Y-shape with respective obtuse space angles between each pair of members, and a plurality of formed lengths connectable between said Y shaped substructural components to thereby form the modular dodecahedrous structure.

13. The modular offshore platform of claim 12 wherein the obtuse angle between each pair of tubular members is 108°.

14. The modular offshore platform of claim 12 wherein said members of said Y-shaped substructural components are tubular.

15. The modular offshore platform of claim 12 wherein each said Y-shaped substructural component is constructed using three U-shaped space components.

16. The modular offshore platform of claim 11 wherein said outer dodecahedrous structure is positioned by use of guy ropes attached thereto.

17. The modular offshore platform of claim 11 further comprising:

an inner dodecahedrous structure having a modular frame comprising a plurality of rigid Y-shaped substructural components, each component comprised of a first, second and third member interconnected to define the Y-shape with respective obtuse space angles between each pair of members, and a plurality of connectors for joining said Y-shaped substructural components to thereby form the modular dodecahedrous structure.

18. The modular offshore platform of claim 17 wherein said inner dodecahedrous structure is positioned from the ocean floor by a riser extending from the ocean floor to said inner dodecahedrous structure.

19. A modular offshore platform support for supporting a drilling platform in a body of water comprising:

an outer dodecahedrous structure having a modular frame construction and a fluid tight outer shell with a first radii, an inner dodecahedrous structure having a modular frame construction and a fluid tight shell having a second radii smaller than the first radii of the outer dodecahedrous structure, the inner dodecahedrous structure positioned within the outer dodecahedrous structure to define a volume therebetween, said volume being fluid tight to provide a bouyant support structure when positioned in the water, and structure to position said platform support in the body of water.

20. The modular offshore platform of claim 19 wherein said support is to support the drilling platform above the floor of the body of water and further comprising risers for supporting said inner and outer dodecahedrous structure from the floor in the body of water.

21. The modular offshore platform of claim 20 wherein said outer dodecahedrous structure is positioned by use of guy ropes attached thereto.

22. The modular offshore platform of claim 20 wherein said inner dodecahedrous structure is positioned by support from a riser from below said inner dodecahedrous structure.

23. The modular offshore platform of claim 19 wherein the outer dodecahedrous structure comprises:

a plurality of rigid Y-shaped substructural components, each component comprised of a first, second and third member interconnected to define the Y-shape with respective obtuse space angles between each pair of members, and a plurality of formed lengths connectable to said Y-shaped substructural components to thereby form the modular dodecahedrous structure.

24. The modular offshore platform of claim 23 wherein the obtuse angle between each pair of tubular members is 108 degrees.

25. The modular offshore platform of claim 23 wherein said members of said Y-shaped substructural components are tubular.

26. The modular offshore platform of claim 23 wherein each said Y-shaped substructural component is constructed using three U-shaped space components.

27. The modular offshore platform of claim 23 wherein the inner dodecahedrous structure comprises:

a plurality of rigid Y-shaped substructural components, each component comprised of a first, second and third member interconnected to define the rigid Y-shape with respective obtuse space angles between each pair of members, and a plurality of formed lengths connectable to said Y-shaped substructural components to thereby form the modular dodecahedrous structure.

28. The modular offshore platform of claim 27 wherein said members of said Y-shaped substructural components are tubular.

29. The modular offshore platform of claim 27 wherein each said Y-shaped substructural component is constructed using three U-shaped space components.

* * * * *

UNITED STATES PATENT AND TRADEMARK OFFICE

CERTIFICATE OF CORRECTION

PATENT NO. : 5,525,011

DATED : June 11, 1996

INVENTOR(S) : HUANG, Yen T.

It is certified that error appears in the above-indentified patent and that said Letters Patent is hereby corrected as shown below:

Title page, under "Abstract" "29 Claims" should read -- 30 Claims--.

Add Claim 30 as follows:

--30. The modular offshore platform of Claim 1 wherein said wherein said outer and said inner dodecahedrous structures are truncated or modified to meet the environmental and operational conditions of the floating structure.--

Signed and Sealed this

Twenty-fourth Day of December, 1996

Bruce Lehman

*Attest:*

BRUCE LEHMAN

*Attesting Officer*

*Commissioner of Patents and Trademarks*